US008585438B2

(12) United States Patent
Tang

(10) Patent No.: US 8,585,438 B2
(45) Date of Patent: Nov. 19, 2013

(54) GROUND MAINTAINING AUTO SEIZING COAXIAL CABLE CONNECTOR

(75) Inventor: Neil H. Tang, Marlboro, NJ (US)

(73) Assignee: Antronix, Inc., Cranbury, NJ (US)

( * ) Notice: Subject to any disclaimer, the term of this patent is extended or adjusted under 35 U.S.C. 154(b) by 115 days.

(21) Appl. No.: 13/425,458

(22) Filed: Mar. 21, 2012

(65) Prior Publication Data

US 2013/0252462 A1 Sep. 26, 2013

(51) Int. Cl.
*H01R 9/05* (2006.01)

(52) U.S. Cl.
USPC ..... 439/578

(58) Field of Classification Search
USPC ..... 439/578, 63, 581, 540.1, 579
See application file for complete search history.

(56) References Cited

U.S. PATENT DOCUMENTS

| | | | | |
|---|---|---|---|---|
| 2,988,727 | A | 6/1961 | Berndt | 339/273 |
| 2,995,388 | A | 8/1961 | Morello, Jr. et al. | 285/340 |
| 3,300,075 | A | 1/1967 | Benoit et al. | 339/253 |
| 3,349,166 | A | 10/1967 | Ziegler, Jr. | 174/88 |
| 3,350,680 | A | 10/1967 | Benoit et al. | 339/253 |
| 3,678,447 | A | 7/1972 | Ziegler, Jr. et al. | 339/177 |
| 3,686,623 | A | 8/1972 | Nijman | 339/177 |
| 3,725,853 | A | 4/1973 | McKeown et al. | 339/252 |
| 3,744,011 | A | 7/1973 | Blanchenot | 439/584 |
| 3,761,870 | A | 9/1973 | Drezin et al. | 339/177 |
| 3,846,738 | A | 11/1974 | Nepovim | 339/177 |
| 3,854,789 | A | 12/1974 | Kaplan | 439/584 |
| 3,858,156 | A | 12/1974 | Zarro | 339/32 |
| 3,891,297 | A | 6/1975 | Poliak et al. | 439/807 |
| 3,944,313 | A | 3/1976 | McKeown et al. | 339/75 |
| 3,989,333 | A | 11/1976 | Cauldwell | 339/177 |
| 3,999,418 | A | 12/1976 | Morell | 72/377 |
| 4,076,367 | A | 2/1978 | Avins | 339/177 |
| 4,226,495 | A | 10/1980 | Palle et al. | 339/177 |
| 4,249,790 | A | 2/1981 | Ito et al. | 339/177 |
| 4,270,824 | A | 6/1981 | Erickson | 339/15 |
| 4,346,958 | A | 8/1982 | Blanchard | 439/584 |
| 4,447,107 | A | 5/1984 | Major, Jr. et al. | 439/584 |
| 4,453,796 | A | 6/1984 | Monroe | 339/177 |

(Continued)

FOREIGN PATENT DOCUMENTS

| | | | |
|---|---|---|---|
| CA | 1132215 | 9/1982 | 439/584 |
| DE | 2415590 | 10/1974 | 439/584 |

(Continued)

OTHER PUBLICATIONS

"Polyoxymethylene," May 28, 2011, pp. 1-4, XP055038697, retrieved from the Internet: URL:http://en.wikipedia.org/w/index.php?title= Polyxomymethylene&oldid=431356461 (retrieved on Sep. 20, 2012).

*Primary Examiner* — Jean F Duverne
(74) *Attorney, Agent, or Firm* — Watov & Kipnes, P.C.; Kenneth Watov

(57) ABSTRACT

A coaxial cable female connector for inclusion in a port of a device or outer shell of a cable connector, includes a centrally located female pin within a pin carrier, the pin has an upper portion with two opposing resilient arms configured for receiving the central pin of a mating male connector. A non-electrically conductive cap is partially covered with an electrically conductive coating, and configured for seating upon said pin carrier, and for maintaining a ground or electrical connection between a shell of a male connector mated to a shell of the female connector, even if the male connector mating to the female connector loosens.

20 Claims, 21 Drawing Sheets

(56) References Cited

U.S. PATENT DOCUMENTS

| | | | | |
|---|---|---|---|---|
| 4,676,577 | A | 6/1987 | Szegda | 339/177 R |
| 4,854,893 | A | 8/1989 | Morris | 439/578 |
| 4,897,045 | A | 1/1990 | Dyck | 439/578 |
| 5,352,134 | A | 10/1994 | Jacobsen et al. | 439/584 |
| 5,586,910 | A | 12/1996 | Del Negro | 439/584 |
| 5,609,501 | A | 3/1997 | McMills et al. | 439/578 |
| 5,651,698 | A | 7/1997 | Locati et al. | 439/578 |
| 6,019,636 | A | 2/2000 | Langham | 439/584 |
| 6,027,373 | A | 2/2000 | Gray et al. | 439/578 |
| 6,071,144 | A | 6/2000 | Tang | |
| 6,102,738 | A | 8/2000 | Macek et al. | 439/584 |
| 6,129,597 | A | 10/2000 | Gresko | 439/583 |
| 6,309,251 | B1 | 10/2001 | Tang | 439/584 |
| 6,755,665 | B2 * | 6/2004 | Lu | 439/63 |
| 7,048,577 | B2 * | 5/2006 | Chung | 439/578 |
| 7,186,138 | B2 * | 3/2007 | Wang | 439/541.5 |
| 2007/0155231 | A1 | 7/2007 | Tang | |
| 2010/0081321 | A1 | 4/2010 | Malloy | |

FOREIGN PATENT DOCUMENTS

| | | | |
|---|---|---|---|
| DE | 2425070 | 12/1975 | 439/583 |
| GB | 2 087 666 A | 5/1982 | |
| GB | 2252458 | 8/1998 | 439/584 |
| WO | WO 2008/151740 A2 | 5/2008 | |

* cited by examiner

GROUND MAINTAINING AUTO SEIZING COAXIAL CABLE CONNECTOR

RELATED INVENTIONS

The present invention is related to U.S. Pat. Nos. 4,897,045, and 6,309,251, issued on Jan. 30, 1990, and Oct. 30, 2001, respectively. The former is entitled "Wire-Seizing Connector For Co-Axial Cable," and the latter is entitled "Auto-Seizing Coaxial Cable Port For An Electrical Device."

FIELD OF THE INVENTION

The field of the present invention relates generally to electrical connectors, and more particularly to coaxial cable connectors.

BACKGROUND OF THE INVENTION

Coaxial cables typically are cables that include the center conductor surrounded by electrically insulated material, typically known as a dielectric material, such as a suitable plastic material. The insulative material is typically itself surrounded by a metal sheath provided in ribbon or braided form. The metal sheath is itself covered by an electrically insulated material, such as a suitable rubber or plastic material. The center conductor of the coaxial cable is typically a highly conductive wire material, usually copper or a copper alloy, but is not limited thereto. Radio frequency signals are typically conducted by the center conductor, whereby the outer metal sheath is typically connected to ground, and provides for electrically or electromagnetically shielding the signal being carried by the center conductor to prevent the signal from emitting radio frequency signals along the length of the cable, provided the ground connection is maintained. Such spurious radiation may interfere with other communications or data transmission, and typically becomes a problem due to intermittent or lost ground connections to the metal sheath or between associated male and female coaxial connectors. Coaxial cables are used in many different communication systems, such as cable television systems, data transmission systems, telecommunication systems, and so forth.

In any system, incorporating coaxial cable for transmitting signals, cable connectors must be used at the ends of the cable for connecting it to the signal transmission system at one end and the signal receiving system at the other end. The widespread use of cable television systems has caused much research and effort over the years to develop improved connectors for terminating the ends of coaxial cable signal lines. Outdoor terminations of coaxial cable must insure that moisture and other environmental contaminants cannot migrate into the connectors used, and by way of such connectors into the housings of electrical devices themselves having connectors for connecting to the ends of coaxial cable signal lines either directly or via a mating connector at the end of the coaxial cable. Cable television components, for example, such as splitters, attenuators, amplifiers, multitaps, and so forth, may include housings that have threaded holes for receiving screw-in coaxial cable connectors via threaded holes in the housings, or may include housings that are diecast with connector ports integral with the housing. The screw-in type connectors are typically more expensive than use of connectors build into diecast ports of a housing. Also, the threaded insert connectors present an additional sealing problem to prevent moisture from entering the housing from the area where the connector screws into the threaded hole of a housing. Other housings incorporating diecast connector ports integral with the housing may eliminate moisture entry problems at the point where the connector port meets the housing. However, presently available RF connector mechanisms (coaxial cable connector mechanisms) secured within the integral ports of an RF component housing may still provide a path for moisture to migrate through the interior of the port and the coaxial cable mechanism into the housing of the associated electrical device, causing electrical failure of the device and reliability problems. There is also a need in the art to provide improved coaxial cable termination mechanisms within connectors for making secure mechanical and positive electrical connection to the center conductor, and a secure ground connection between the connectors and the metal sheath of the associated coaxial cable or cables, while at the same time insuring proper impedance matching. It is also important to ensure that the connector mechanisms used for terminating or securing the center conductor of the coaxial cable cannot be pulled out from their associated port or connector housing during use. Also, it is important to insure, for example, that if the mechanical attachment between male and female coaxial cable connectors loosens, for example due to vibration, temperature changes, etc., the electrical ground connection between them is retained. Another problem in the art is the burden of having to accurately machine the ports of diecast housings to insure proper operation of connector mechanisms. Recent coaxial cable connector designs include a centrally located female pin that receives the end of the center conductor of a coaxial cable for the coaxial cable, or male pin of a coaxial cable male connector, for terminating the same. It is also important that the female pin make maximum mechanical and electrical contact with a male pin or directly with the center conductor of a coaxial cable.

SUMMARY OF THE INVENTION

With the problems of the prior art in mind, it is an objective of the present invention to provide an improved female coaxial cable connector, including means for maintaining a ground or common electrical connection between the shells of the present connector and a mated male connector even if the mechanical connection therebetween loosens.

A further objective of the invention is to provide an improved coaxial connector that is mechanically held in position for preventing the associated mechanism from being pulled out of its housing or outer port.

Yet another objective is to reduce the burden of having to machine the interior portions of the ports of diecast housings to obtain proper electrical connector operation.

With these and other objectives in mind, and with the problems of the prior art in mind, in one embodiment of the invention a female connector mechanism for retention in either a threaded connector shell for screwing into the housing of an electrical device, or for installation into the diecast connector port integral with the housing of an electrical device, includes a centrally located round female pin retained within a pin carrier between two resilient opposing arms in an uppermost portion thereof, the bottommost portion being configured for frictionally securing the connector mechanism within the outer shell providing a connector housing. The outer shell or port provides both mechanical and electrical connection to an outer shell of a male coaxial connector, the electrical connection provided being between outer shielding and/or a source of reference potential, such as ground for example. The upper portion of the pin includes two opposing round spring-like arms configured for receiving therebetween the end of the center connector of a coaxial cable or the associated central pin of a mating male coaxial connector, in this example. The resilient arms of the pin carrier are made from a single piece of material, and include two opposing finger-like pawls juxtaposed to opposite sides of the resilient arms in alignment with a gap between the resilient arms. A cap of electrically non-conductive or insulative material is installed over the top portions of the resilient arms and the female pin, and juts partly out of the outer shell or housing of the connector. The top of the cap includes a centrally located hole configured for guiding the center conductor of a coaxial cable or male pin of a mating male connector into the central portion of the female pin of the present connector. The cap is configured to move downward, exert an inward force on the resilient arms of a pin carrier as the mating connector shell is screwed onto the shell of the present connector, for ensuring very positive mechanical and electrical connection between the center conductor of the coaxial cable and the female pin of the present connector mechanism. The cap also includes in one embodiment of the invention holes proximate its bottom portion for receiving the pawl fingers of the pin carrier, for both providing retention of a cap within the associated connector shell, and for limiting downward motion of the cap only to the extent necessary for moving the resilient arms of the pin carrier inward, for insuring the previously mentioned mechanical and electrical connection between the associated female pin and the center conductor of the associated coaxial cable or mating male connector.

In another and important embodiment of the invention, an integral layer or cover of electrically conductive material is secured to outer and side portions of the cap to insure maintenance of a good ground connection between mated male and female coaxial connectors even if the mechanical connection between the connectors loosens.

In another embodiment of the invention, the female pin is provided with a hole proximate the point where the bottom portion of the female pin protrudes out of the pin carrier, for permitting moisture sealant material to be injected into the pin up to the point where the split arms of the pin reside, and to be injected into the lowermost portion of the pin below the entry hole for sealant, with moisture sealant material also being deposited within the hole from which the bottom of the pin protrudes into the housing of the electrical device, thereby preventing moisture from migrating through the connector mechanism into the housing of the electrical device.

In yet another embodiment of the invention, the pin carrier is configured to include a resilient locking ring for securely mechanically retaining the pin carrier within the barrel of the connector port of the electrical device, thereby also ensuring that the connector mechanism cannot be pulled out of the port barrel or longitudinally moved in a manner that may break the connection between the female pin and circuitry within the housing of the electrical device.

BRIEF DESCRIPTION OF THE DRAWINGS

Various embodiments of the present invention will be described in detail with reference to the accompanying drawings, in which like items are identified by the same reference designation, wherein.

DETAILED DESCRIPTION OF THE INVENTION

Figure 1:
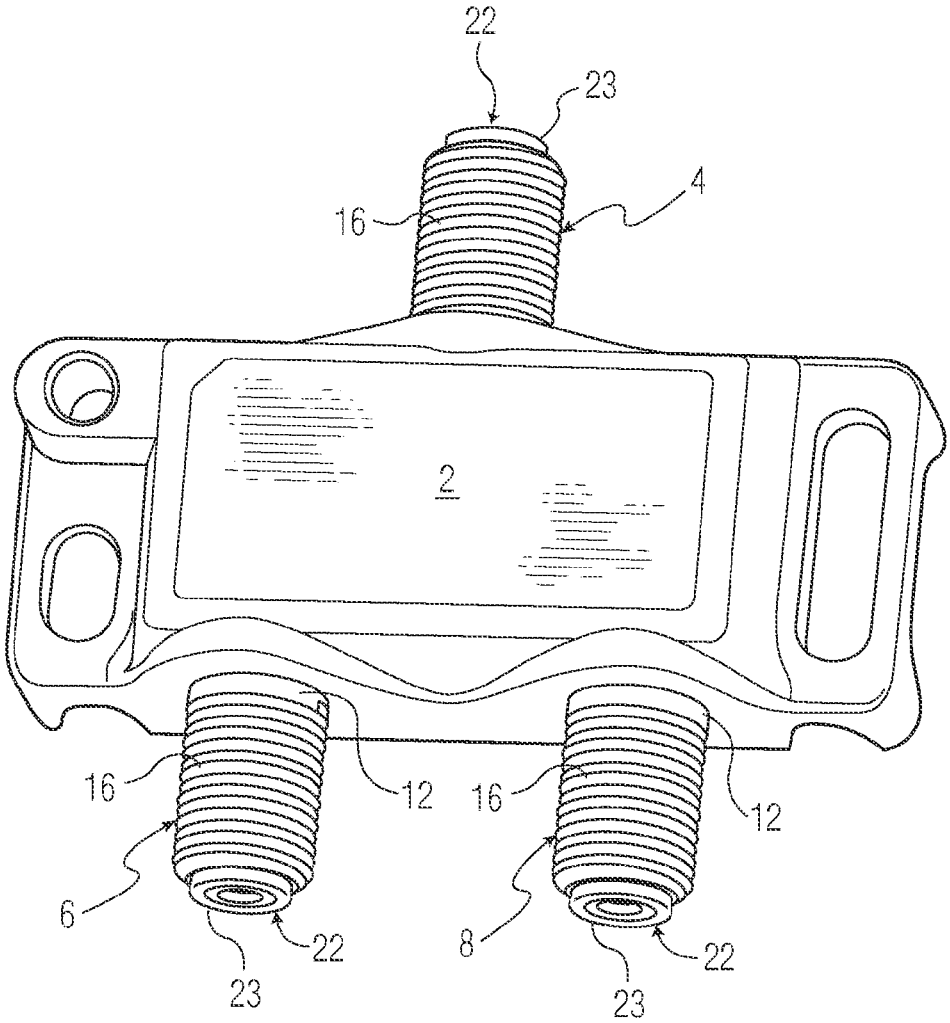
FIG. 1 is a pictorial view of a splitter device incorporating an embodiment of the present invention.

In FIG. 1, a splitter 2 is shown, in this example a two-way splitter that includes an input port 4, and first and second output ports 6, 8, respectively. Each of the ports 4, 6, 8 include threaded barrel 12 of electrically conductive material enclosing an electrical connector mechanism that includes a cap 22 of electrically non-conductive material that has a top end slightly protruding from its associated barrel 12, as shown. Also, as will be explained in detail below, the cap 22 has a layer or cover of electrically conductive material 23 secured portions of its top and sidewalls for electrically conductive contact via frictional engagement with interior wall portions of barrel 12. The barrels 12 can be included as part of a diecast housing for the splitter 2, or can be provided by separate screw-in type connectors, as will be discussed below. Typically, such ports and connector mechanisms provide F type connectors, but the present invention is not meant to be limited to F type connectors.

Figure 2A:
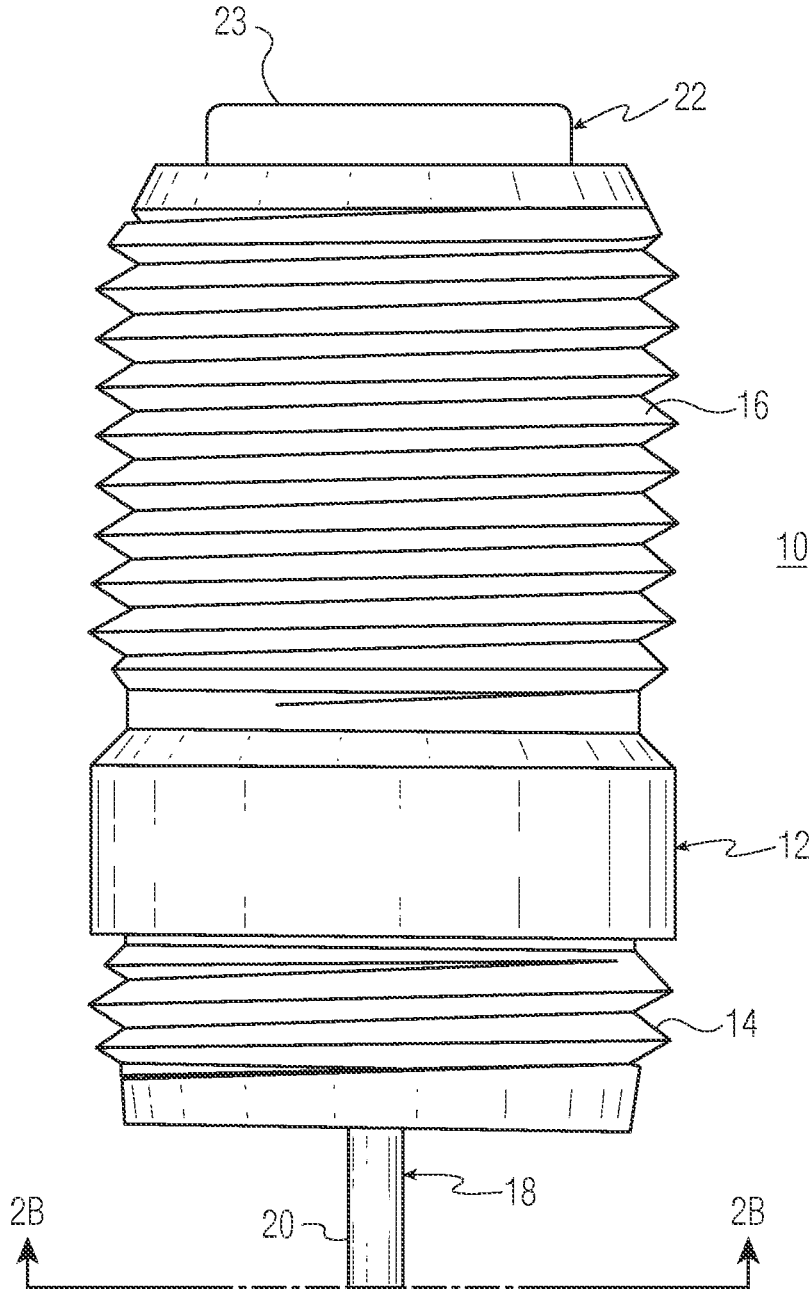
FIG. 2A is front elevational view of a screw-in F-Type coaxial connector, for example, incorporating one embodiment of the invention.
Figure 2B:
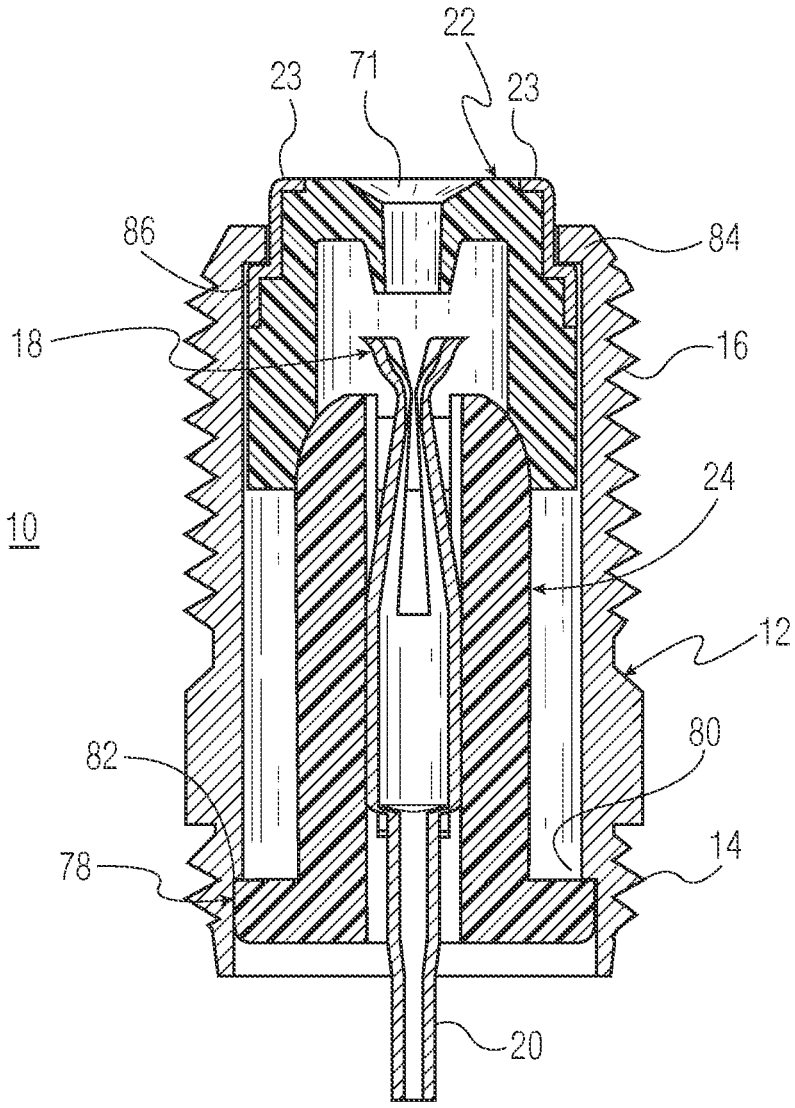
FIG. 2B is a cross-sectional view taken along 2B-2B of FIG. 2A showing a connector mechanism that is installed into the bottom opening of an associated connector shell.
Figure 2C:
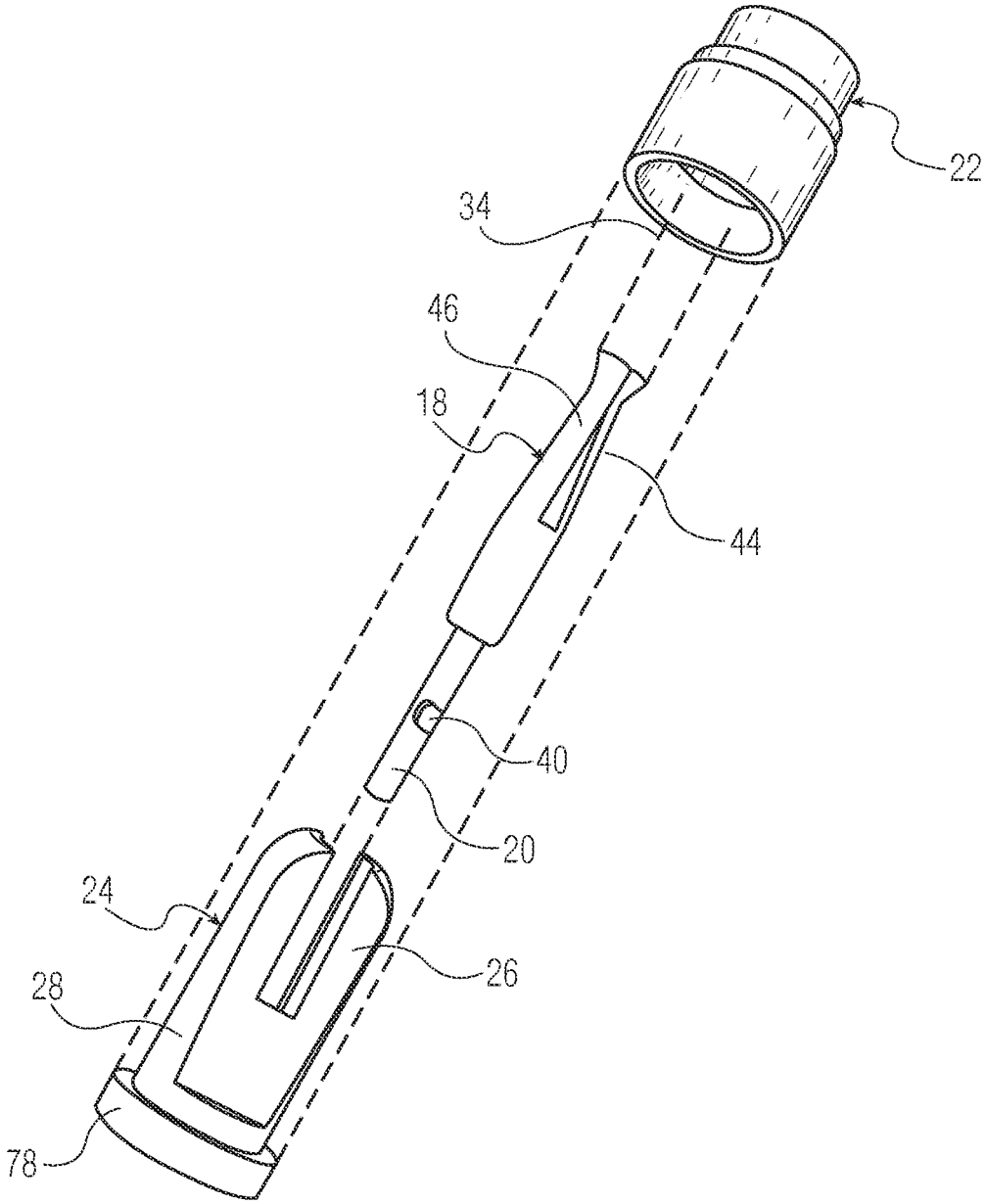
FIG. 2C is an exploded pictorial assembly view of the interior components of the auto-seizing coaxial cable connector mechanism assembly shown in FIG. 2B.

FIGS. 2A, 2B, and 2C through 4 show pictorial views of screw-in type connectors, typically F type connectors 10, that can be secured to housings by screwing the bottom threaded portions 14 into threaded holes of the housing at each port location. As shown, the screw-in electrical connectors each include a barrel 12 having a bottom threaded portion 14, and top threaded portion 16, enclosing an electromechanical connector mechanism. The electrical connector mechanism includes a cap 22 with electrically conductive cover 23 thereon, a portion of which is protruding out of the top of the barrel 12, and a centrally located rounded electrical pin 18 having a bottom portion 20 protruding from the bottom of the barrel 12, as shown, in this example. The cap 22 also includes a centrally located pin guide hole 71 for receiving a male pin or center coaxial cable conductor from a male F type connector adapted for securement to the illustrated female F type connector 10. Note that the electrical pin 18 is not meant to be limited to the rounded pin that will be discussed in detail below. Reference is made to FIG. 2B for a longitudinal cross-section taken along 2B-2B of FIG. 2A. As shown in this example, the connector mechanism includes the cap 22, the rounded electrical pin 18 configured as shown, a pin carrier 24, a lowermost locking ring 78 being provided on the pin carrier 24, with a lower portion 20 of the pin 18 protruding from the bottom of the barrel 12, as previously mentioned. The open top of the barrel 12 includes a peened over portion 84 that abuts against a step-like portion 86 of the cap 22, for slidingly retaining the cap 22 within the barrel 12 as shown. The barrel 12 also has an enlarged diameter bottommost portion 82 for receiving a locking ring portion 78 of the pin carrier 24. The locking ring 78 of pin carrier 24 has a slightly larger outside diameter than the enlarged portion 82 of the barrel 12, for providing a frictional fit that prevents longitudinal and rotational movement of the pin carrier 24 within the barrel 12.

Note that the embodiments of the invention for barrels 12 as shown in FIGS. 2A, and 2B through 4 to provide screw-in parts to an associated housing, typically have a connector assembly inserted into the barrel 12 from the bottom thereof. However, other embodiments of the present invention as described below provide for inserting the connector assembly into the top or free end of a barrel or port for ease of assembly.

Figure 5:
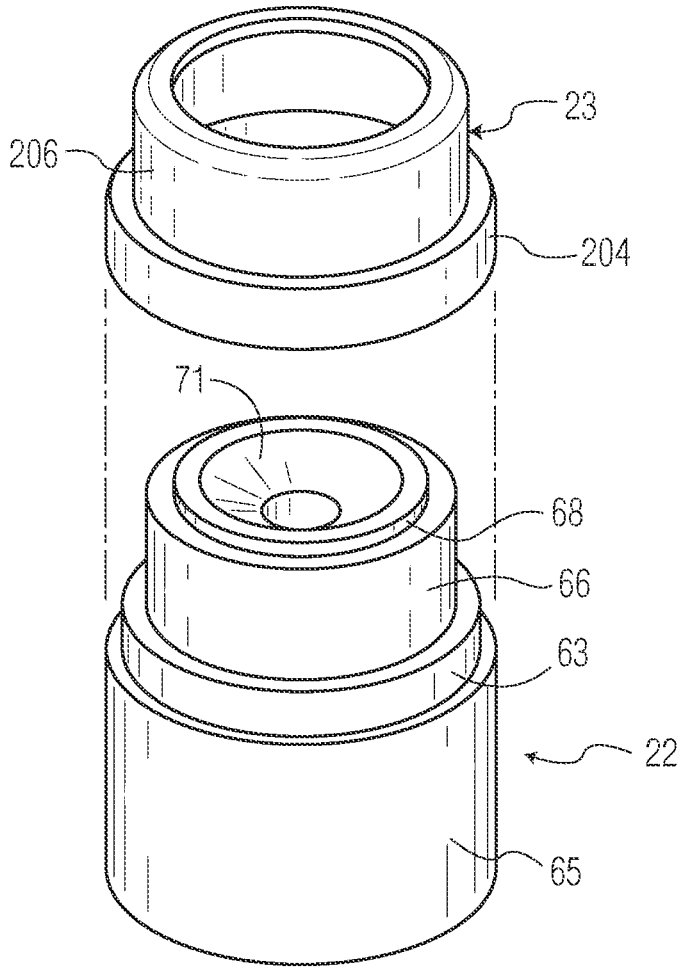
FIG. 5 is an exploded pictorial assembly view of the layer or cover configuration of electrical conductive material to be installed on an insulative cap for an embodiment of the invention.
Figure 6:
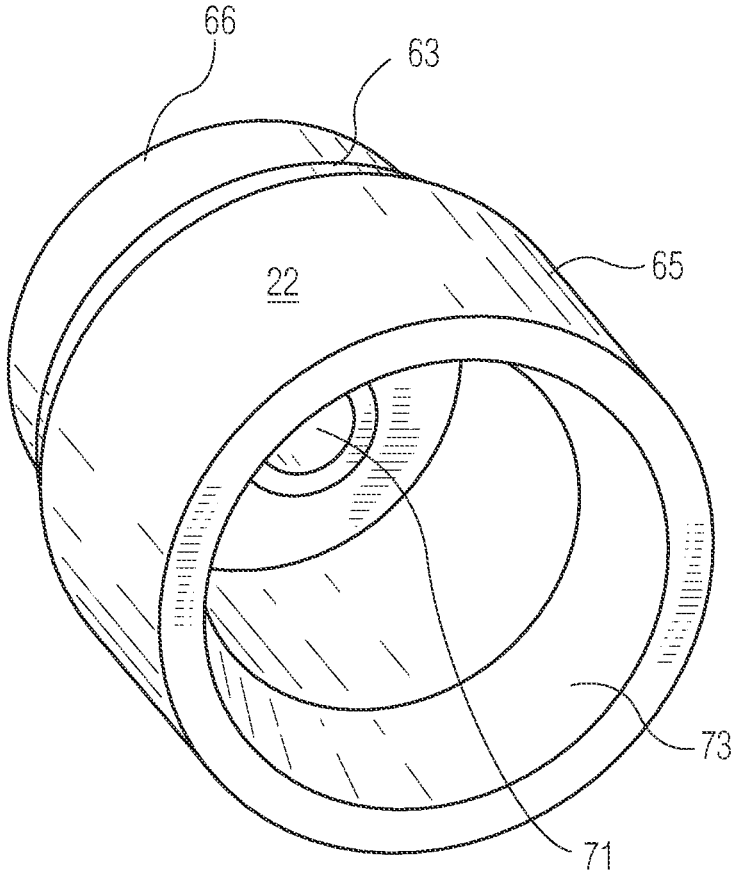
FIG. 6 is a pictorial view looking toward the bottom of the cap of FIG. 5 for an embodiment of the invention.
Figure 7:
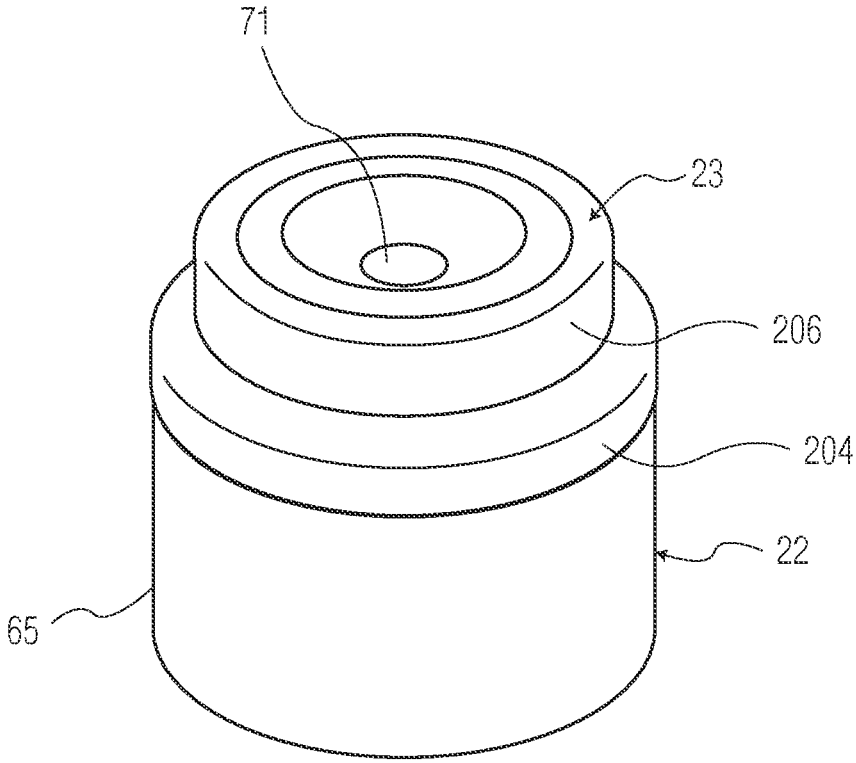
FIG. 7 is a pictorial view looking toward the top of the cap of FIG. 6 with an electrically conductive cover installed thereon, for an embodiment of the invention.

In FIG. 5, a pictorial exploded assembly view is shown for an embodiment of the invention that includes the cap 22 positioned for receiving an electrically conductive cover 23. The cap 22 includes a lower portion 65 followed by a top portion of step-like successively reduced diameter portions 63, 66, and 68, respectively. The cover 23 has step-like portions 204 and 206, which encircle steps 63 and 66, respectively. In FIG. 6, a pictorial view of the modified cap 22 is shown looking toward the bottom. A partially beveled pin guide hole 71 is used to guide a male pin of a mating connector (typically the center conductor of a coaxial cable) through the hole 71 and into electrical pin 18 (see FIG. 2B). The lowermost inside wall portion 73 of cap 22 is beveled having an outwardly diverging circular configuration, as shown. FIG. 7 is a pictorial view of cap 22 with electrical cover 23 installed thereon.

Figure 8:
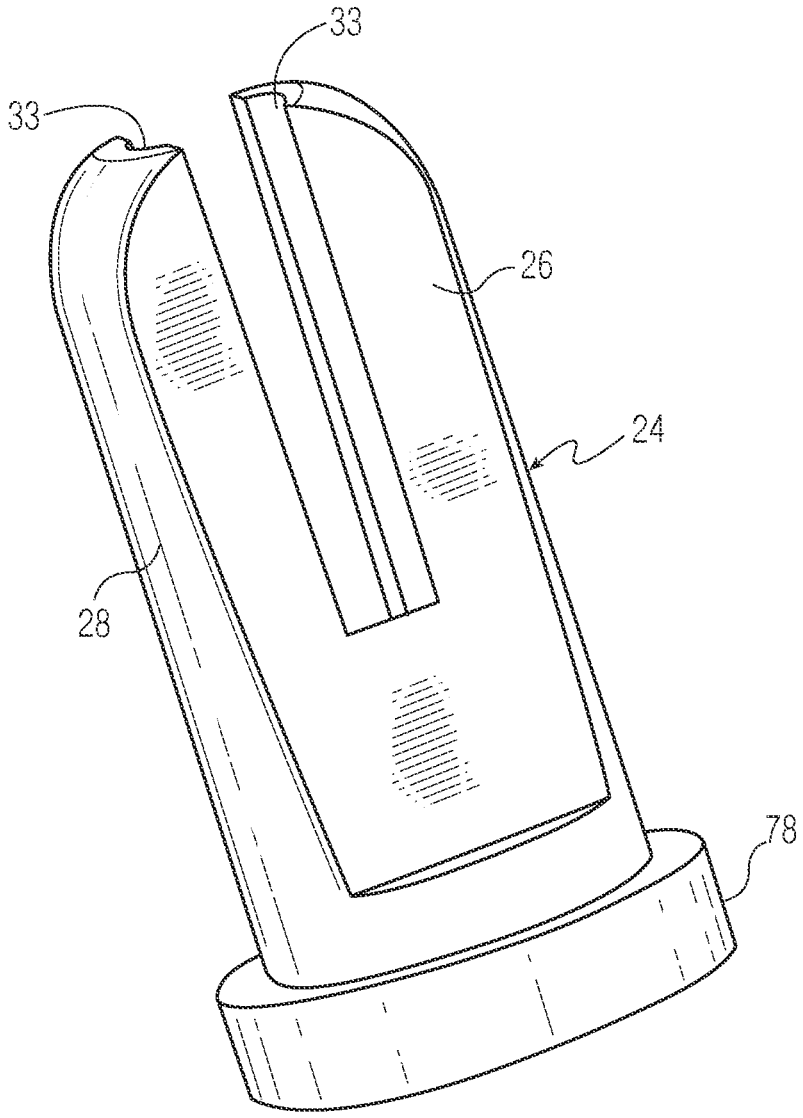
FIG. 8 is a pictorial view of a pin carrier element of the connector assembly of FIG. 2B, for one embodiment of the invention.

FIG. 8 shows a pictorial view of the pin carrier 24 without the inclusion of an electrical pin 18. Note that the pin carrier 24 includes opposing resilient arms 26 and 28, each of which include longitudinal interior rounded or partially semi-circular grooves 33 for receiving electrical pin 18. The locking ring 78 forms the bottom portion of pin carrier 24.

Figure 9A:
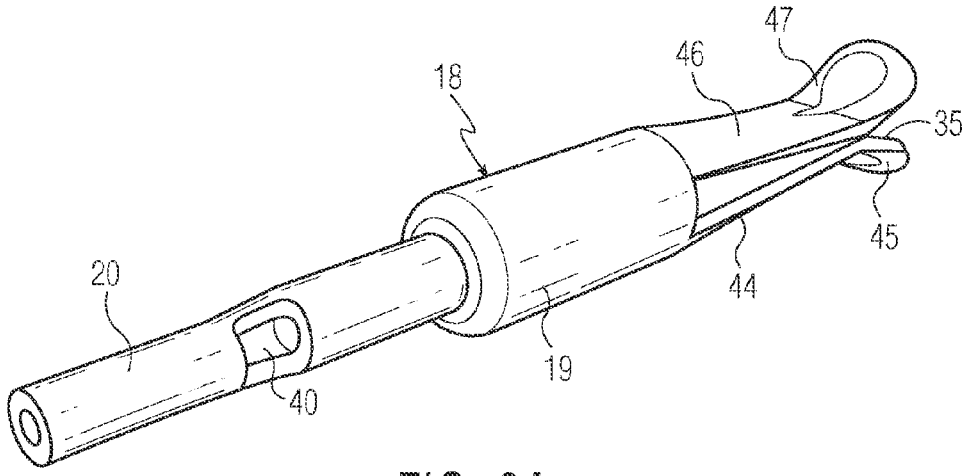
FIG. 9A is a pictorial view of a female pin for an embodiment of the invention.
Figure 9B:
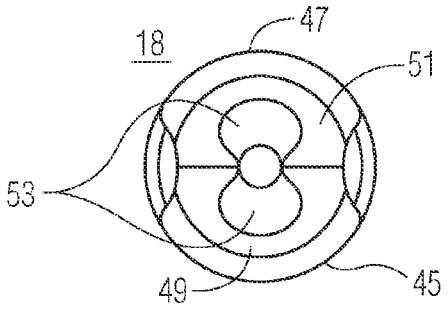
FIG. 9B is a top plan view of the female pin of FIG. 9A.
Figure 9C:
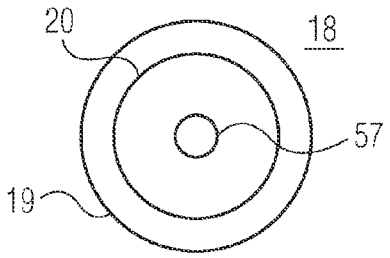
FIG. 9C is a bottom plan view of the female connector of FIG. 9A.
Figure 9D:
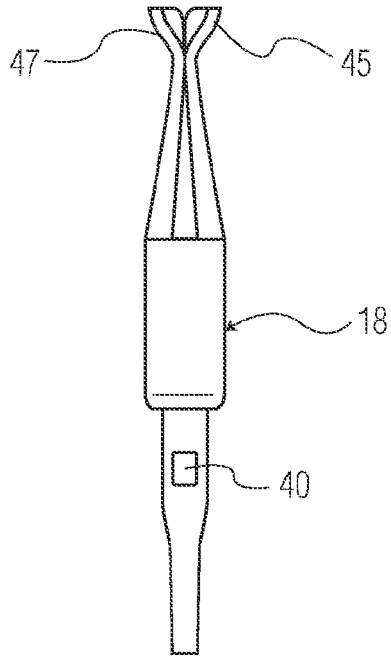
FIG. 9D is a side view of the female pin of FIG. 9A.
Figure 9E:
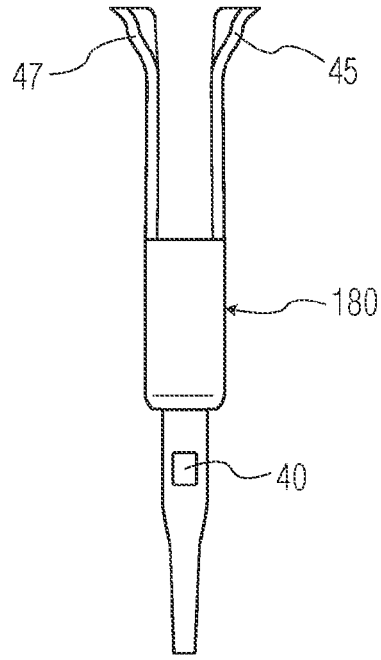
FIG. 9E is a side view of a female pin for another embodiment of the invention.

FIG. 9A shows a pictorial view of a rounded female pin 18 for various embodiments of the invention. As shown, the upper portion of the pin includes two opposing rounded spring arms 44, 46, respectively. The top portion of the spring arms 44, 46 each include flared or upwardly diverging end portions 45, 47, respectively, which have their interior opposing surfaces configured to provide a pin guide pathway 35 for receiving the male pin or center conductor of a coaxial cable of a mating male connector, as will be described. The female pin 18 also includes a pin sealant hole 40 proximate the bottom portion 20. The center portion 19 of pin 18 has a larger diameter than the bottom portion 20. In FIG. 9B, the top view of the pin 18 shows that the inside wall portions 49, 51 of the flared end portions 45, 47, respectively, are each rounded, concave, and each include a centrally located partially semi-circular portion 53. In FIG. 9C, a bottom view of pin 18 is shown. The bottom includes a hole 57 which goes all the way through to the central portion 19 of pin 18. FIGS. 9D and 9E show side view of pins 18 and 180 with inside portions of flared end 45, 47, normally touching for use in home installations, and spaced apart for commercial installations, respectively. The commercial version of pin 180 helps to reduce frictional removal of coated material from an associated male pin 180 and flared ends 45, 47 during installation and removal of the male pin.

Figure 10:
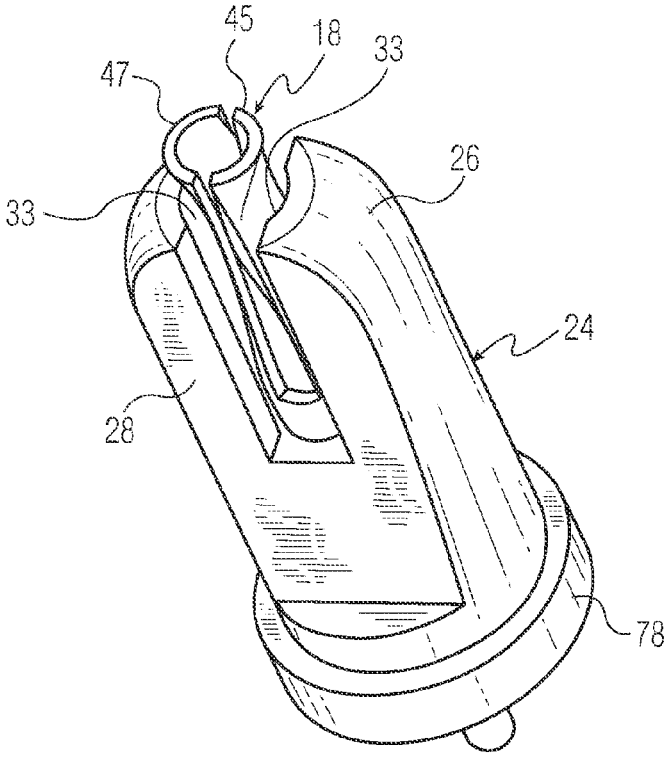
FIG. 10 is a pictorial view of the pin carrier of FIG. 8 in which a pin of FIG. 9D has been installed.
Figure 11:
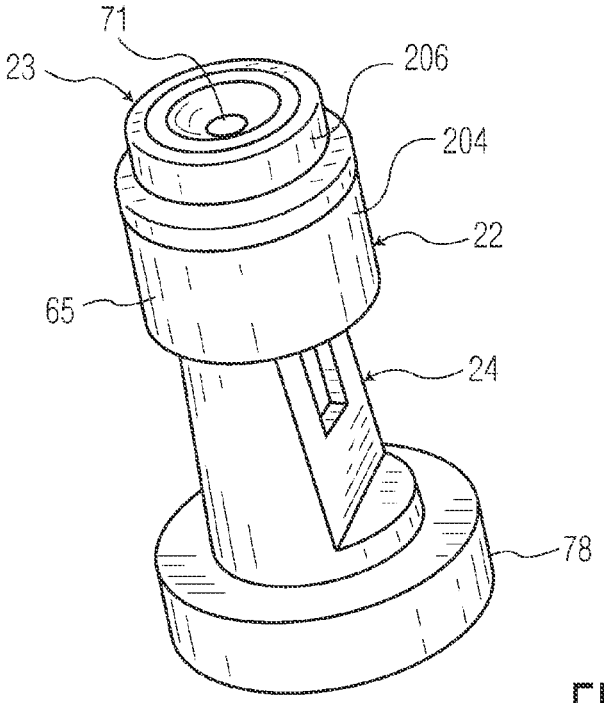
FIG. 11 is a pictorial view of the cap with insulative cover assembly of FIG. 5 installed in the pin carrier of FIG. 8.

FIG. 10 is a pictorial view showing the electrical pin 18 as mounted within pin carrier 24, between opposing resilient arms 26 and 28. FIG. 11, is a pictorial view showing the cap 22 with electrically conductive cover 23 mounted upon the pin carrier 24.

Figure 12:
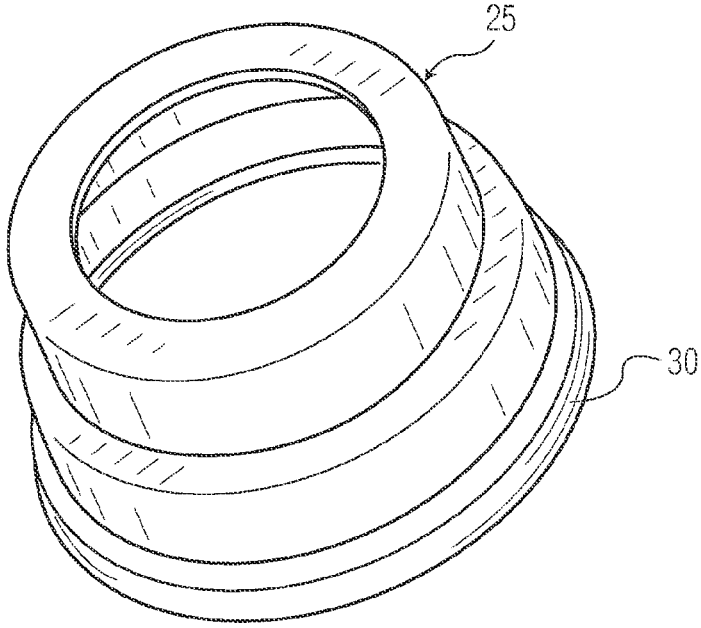
FIG. 12 is a pictorial view looking toward the top of a layer or cover of electrical conductive material for another embodiment of the invention, for installation on the cap of FIG. 5.
Figure 13:
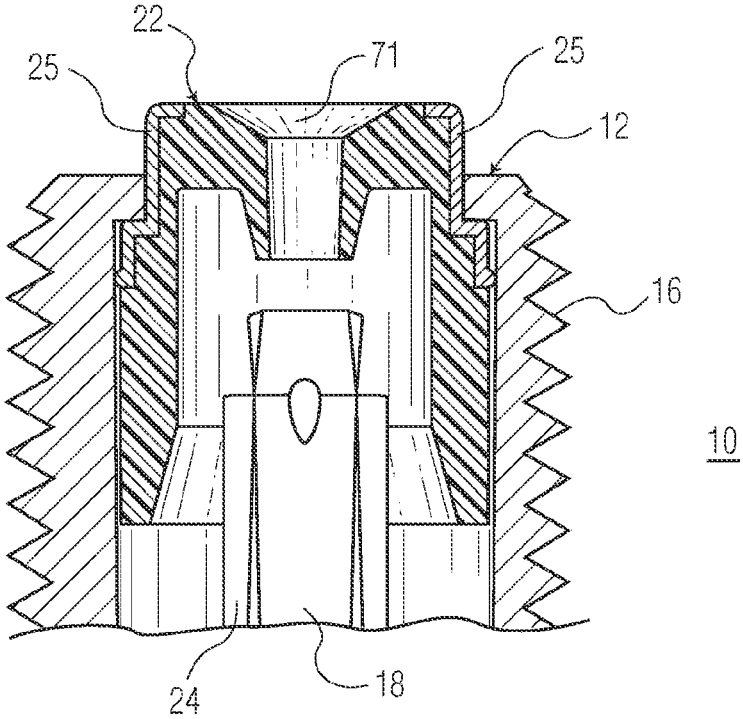
FIG. 13 is a cross-sectional view of the installation of the electrically conductive cover of FIG. 12 installed on the cap of FIG. 5 within the barrel of a coaxial cable connector.

With reference to FIG. 12, a pictorial view is shown of an electrically conductive cover 25 for another embodiment of the invention. The cover 25 is similar to the cover 23, but differs in that it includes a protruding circular band 30 about its lowermost or bottom portion. In FIG. 13, a cross-sectional view is shown of an upper portion of connector 10, in this example, showing the cap 22 with cover 25 as installed therein. The band 30 frictionally engages the interior wall portions of barrel 12 to maintain electrical conductivity therewith.

Figure 14:
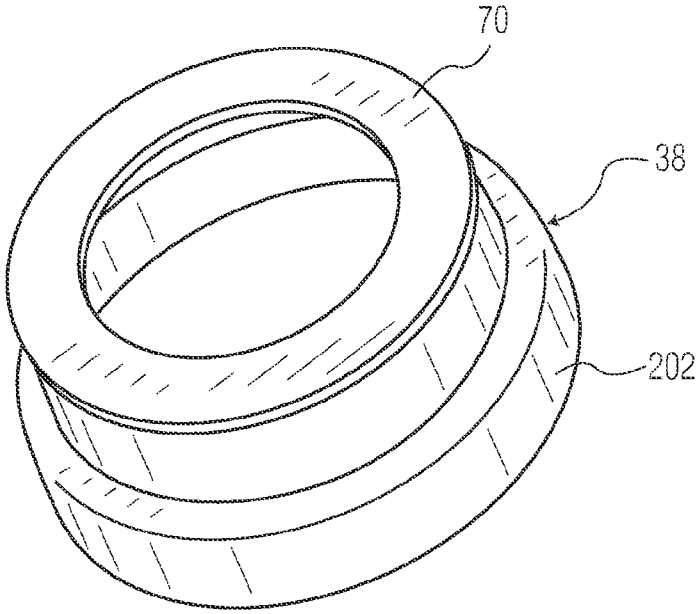
FIG. 14 is a pictorial view looking toward the top of a layer or cover of electrically conductive material for installation on the cap of FIG. 5, for another embodiment of the invention.
Figure 15:
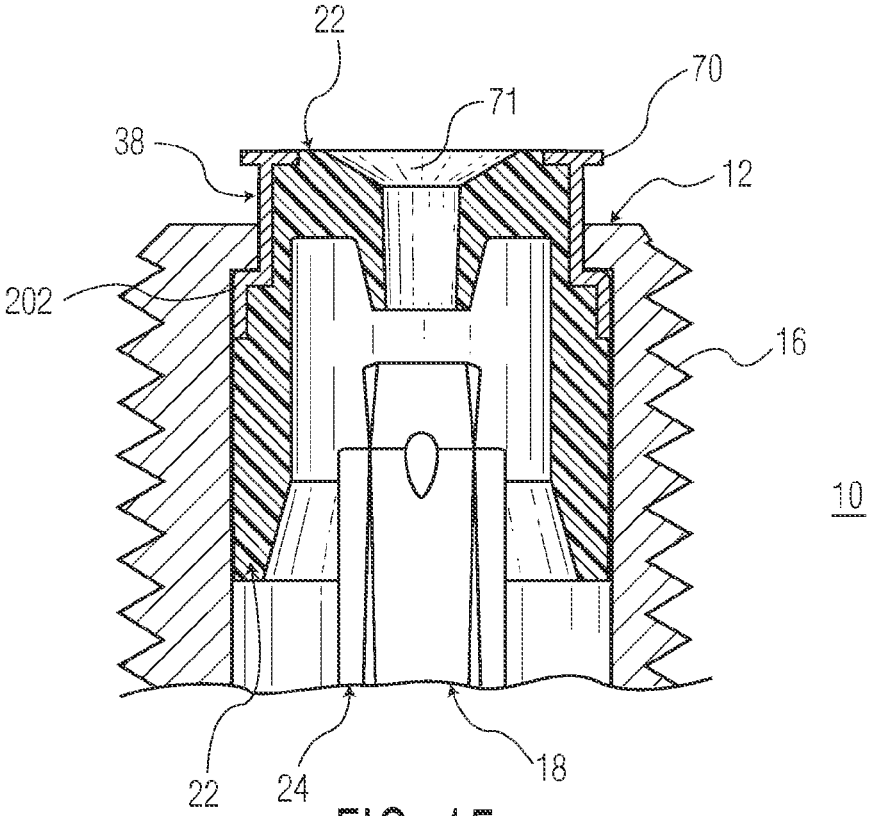
FIG. 15 is a cross-sectional view of the installation of the electrically conductive cover of FIG. 14 installed on the cap of FIG. 5 within the barrel of a coaxial cable connector, for yet another embodiment of the invention.

FIG. 14 shows a pictorial view of an electrically conductive cover 38 for another embodiment of the invention that differs from cover 23 in that the former includes a narrow protruding circular flange 70 about its topmost portion. In this example flange 70 has an outside diameter that is about the same diameter as the lowermost portion of cover 38. In FIG. 15, a cross-sectional view is shown of an upper portion of connector 10, in this example, showing the cap 22 with cover 38 as installed therein.

Figure 16:
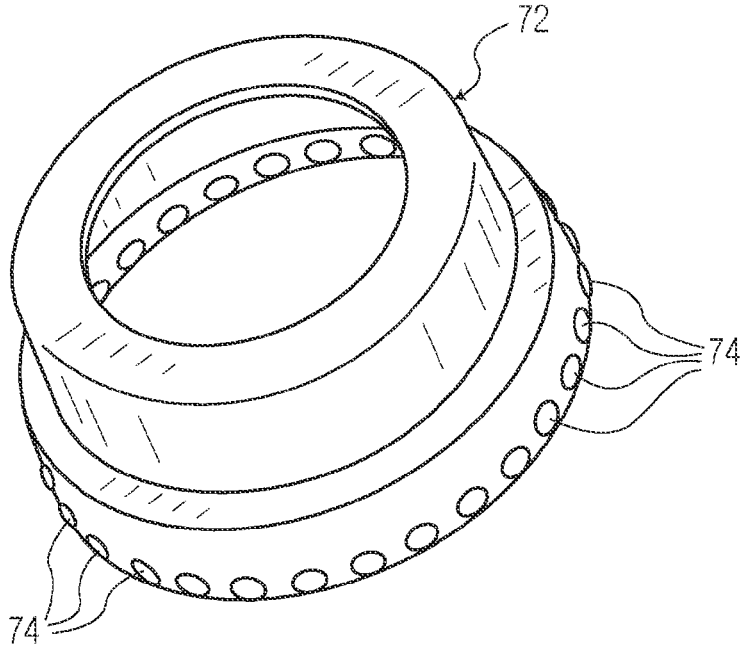
FIG. 16 is a pictorial view looking toward the top of a layer or cover of electrically conductive material for installation on the cap of FIG. 5, for another embodiment of the invention.
Figure 17:
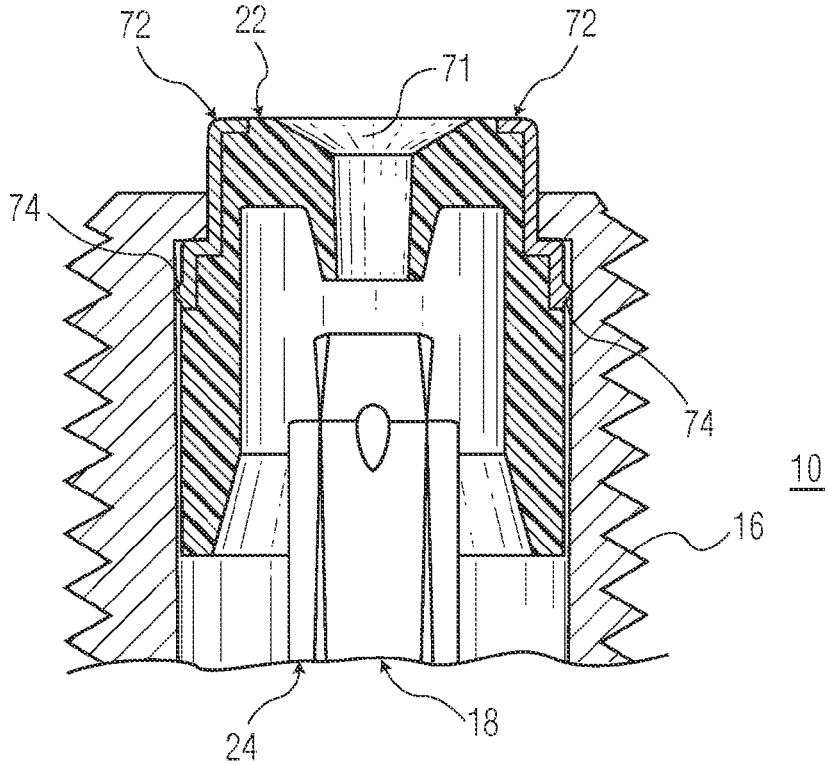
FIG. 17 is a cross-sectional view of the installation of the electrically conductive cover of FIG. 16 on the cap of FIG. 5 within the barrel of a coaxial cable connector, for another embodiment of the invention.

With reference to FIG. 16, a pictorial view of an electrically conductive cover 72 for yet another embodiment of the invention that differs from cover 23 in that the former includes a plurality of spaced apart protruding nibs or dimples 74 around a lower portion of its outer circumferential sidewall of its lowermost portion, as shown. In FIG. 17, a cross sectional view is shown of an upper portion of connector 10, in this example, showing the cap 22 with cover 72 installed thereon. Note that the cross section is taken through the center of diagonally opposing nibs 74 of cover 72.

Figure 18:
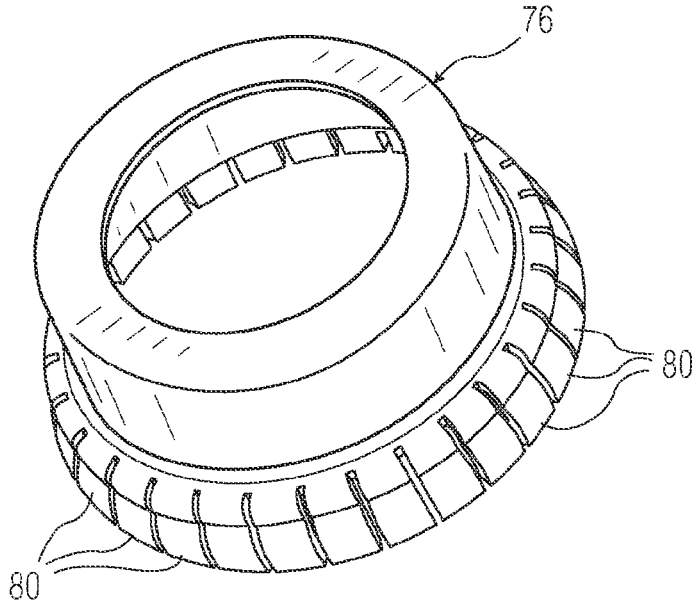
FIG. 18 is a pictorial view looking toward top of a layer or cover of electrically conductive material for installation on the cap of FIG. 5, for another embodiment of the invention.
Figure 19:
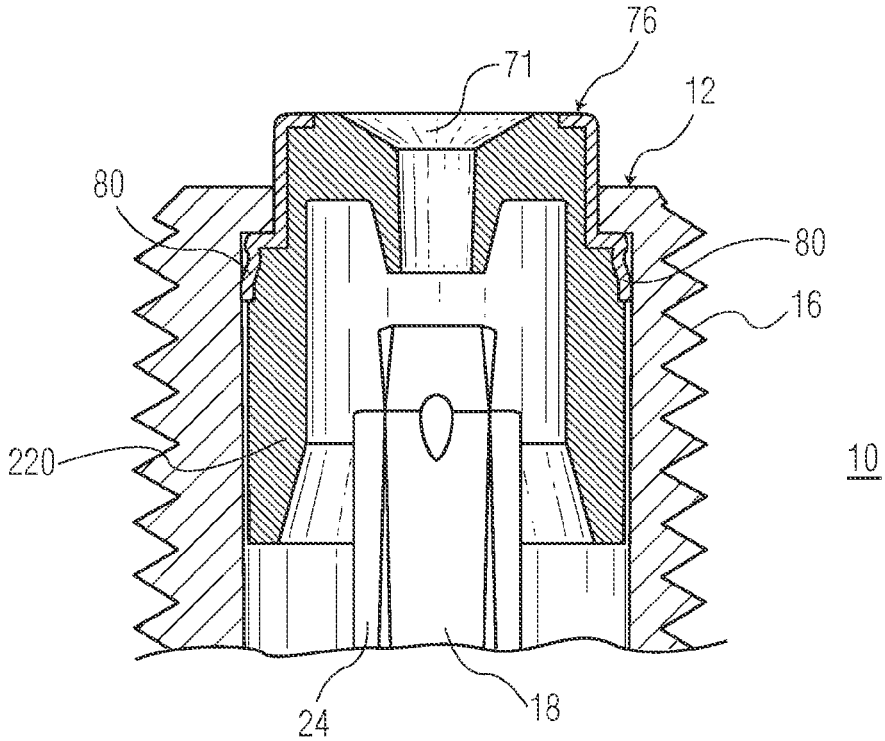
FIG. 19 is a cross-sectional view of the installation of the electrically conductive cover of FIG. 18 on the cap of FIG. 5 within the barrel of a coaxial cable connector, for another embodiment of the invention.

With reference to FIG. 18, a pictorial view of an electrically conductive cover 76 is shown for another embodiment of the invention that differs from cover 23 in that the former includes a plurality of spaced apart successive flexible resilient or spring-like fingers 80 about and forming the circumference of its lowermost step-like largest diameter sidewall portion, as shown. FIG. 19 shows a cross-sectional view of an upper portion of connector 10, in this example, showing a modified cap 220 relative to cap 22, with cover 76 installed thereon. Note that the cross-section is taken through the center of diagonally opposing fingers 80 of cover 76.

Figure 3:
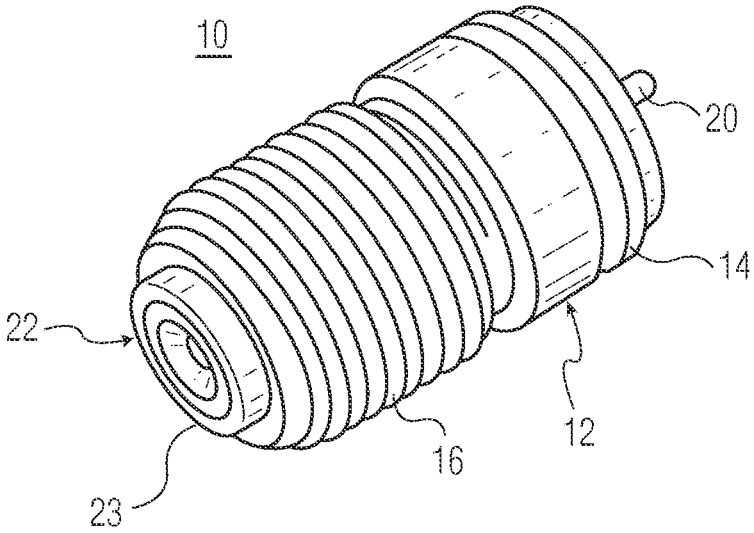
FIG. 3 is a pictorial view looking toward the front of the connector example of FIG. 2.
Figure 4:
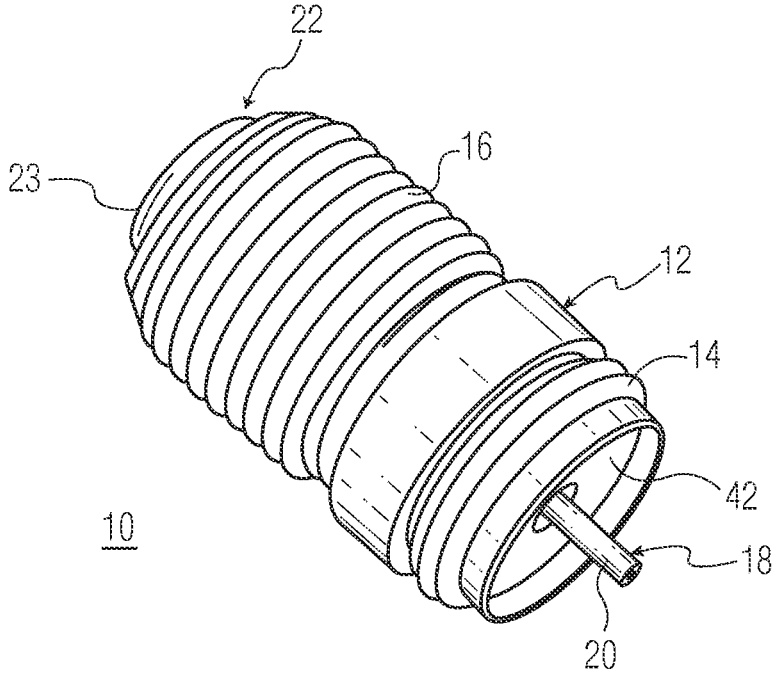
FIG. 4 is a pictorial view looking toward the bottom of the connector example of FIG. 2.
Figure 20:
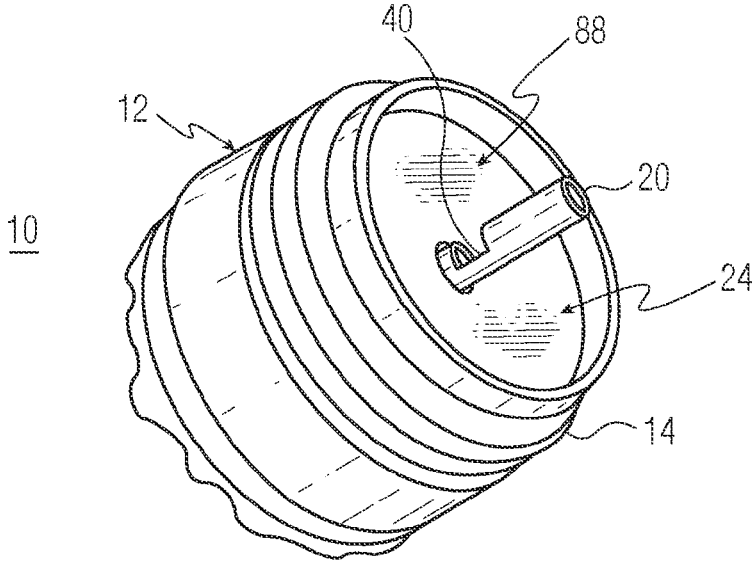
FIG. 20 is a partial pictorial view of the bottom of the screw-in connector of FIG. 2 without installation of moisture sealant material.
Figure 21:
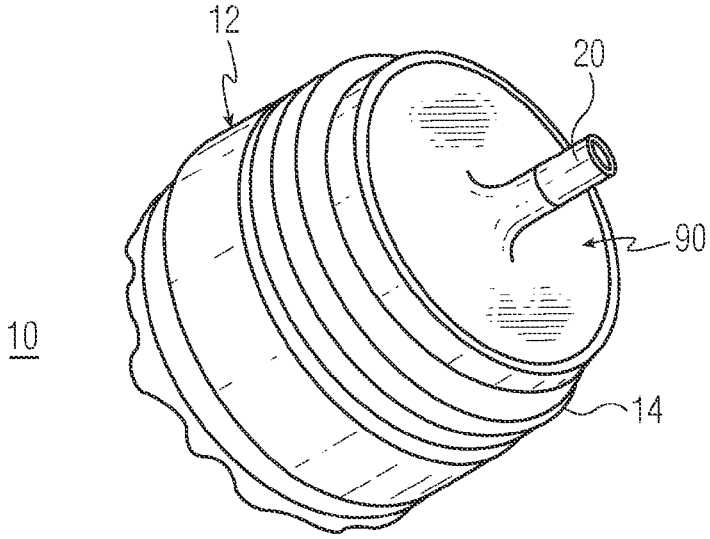
FIG. 21 is a partial pictorial view of the bottom of the screw-in connector of FIG. 2 with moisture sealant material installed.

With reference to FIG. 20, a partial pictorial view of the bottom of the connector of FIGS. 3 and 4 without installation of sealant material is shown. At this point in the assembly of the electrical connector mechanism of the present invention, the bottom 88 of the pin carrier 24, and lower portion 20 of the electrical pin 18 cannot prevent moisture entering into the barrel 12, from migrating into the housing of an electrical device to which the present electrical connector assembly 10 is installed. To prevent such passage of moisture, as shown in FIG. 21, a sealant 90 such as RTV, or an appropriate epoxy, for example, is installed in the bottommost portion of the barrel 12 encapsulating the bottom 88 of pin carrier 24. Also, sealant material is injected into the pin sealant hole 40, and forced through the center of the pin 18 into the bottom portion 20 of electrical pin 18 for substantially blocking any migration of moisture through the present connector mechanism into the housing of an associated electrical device. FIG. 21 shows the bottom of the barrel 12 after RTV 90, in this example, has been installed over the bottom 88 of pin carrier 24, and also injected into the bottom portions 20 of the electrical pin 18, as indicated.

Figure 22:
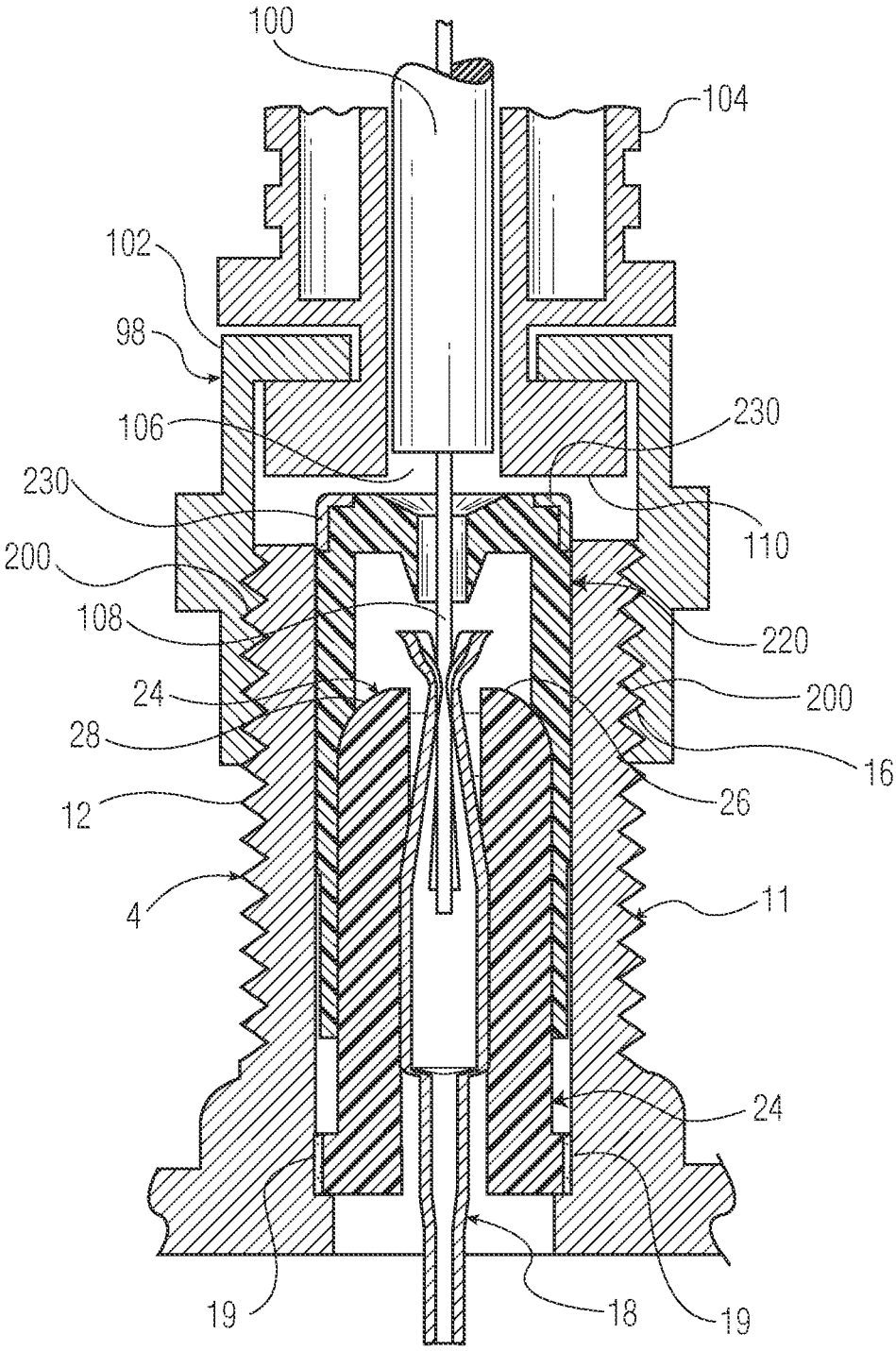
FIG. 22 is a cross-sectional view showing the partial installation of a male coaxial cable connector on a female connector for one embodiment of the invention.
Figure 23:
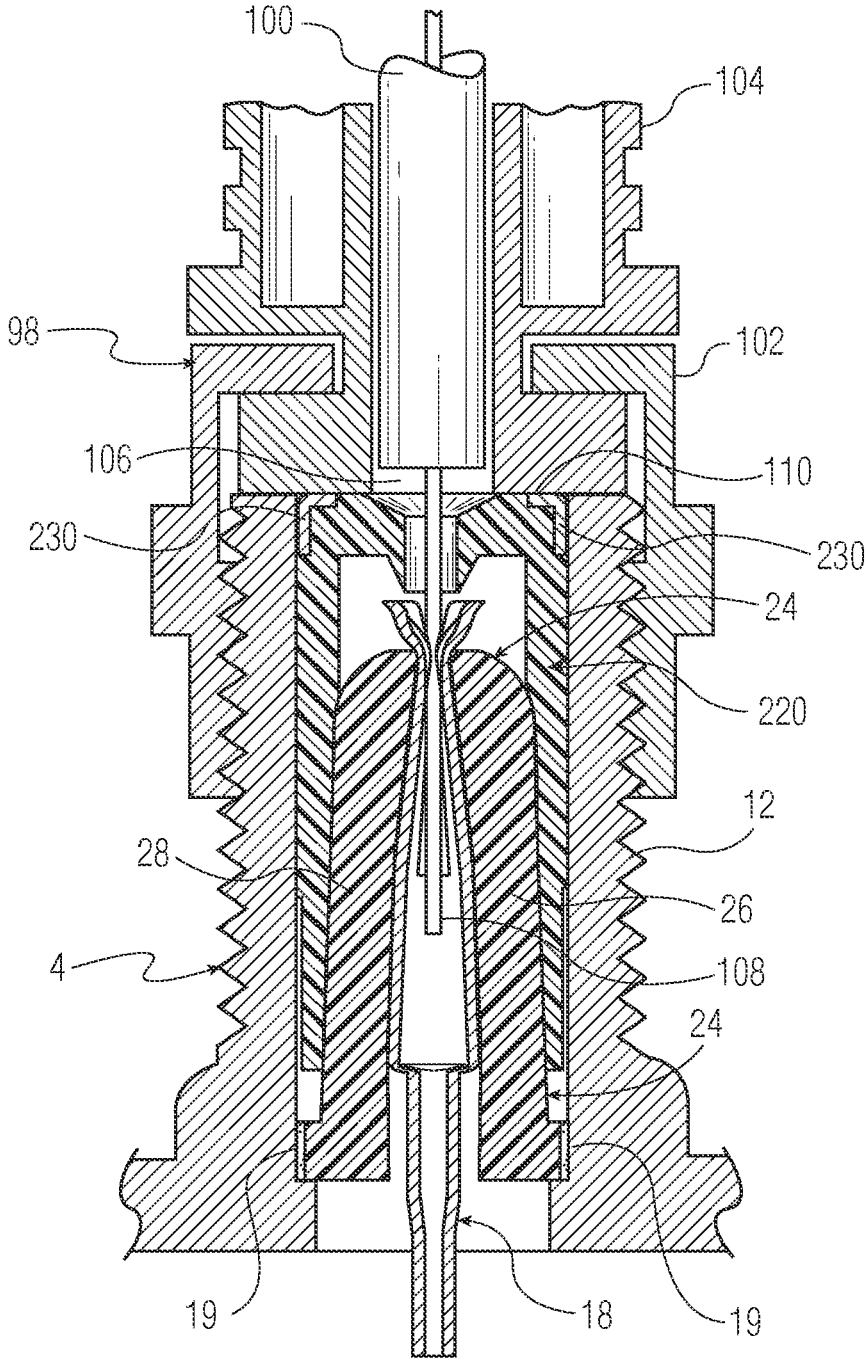
FIG. 23 is a cross-sectional view showing final installation of the male coaxial cable connector relative to FIG. 22.
Figure 24:
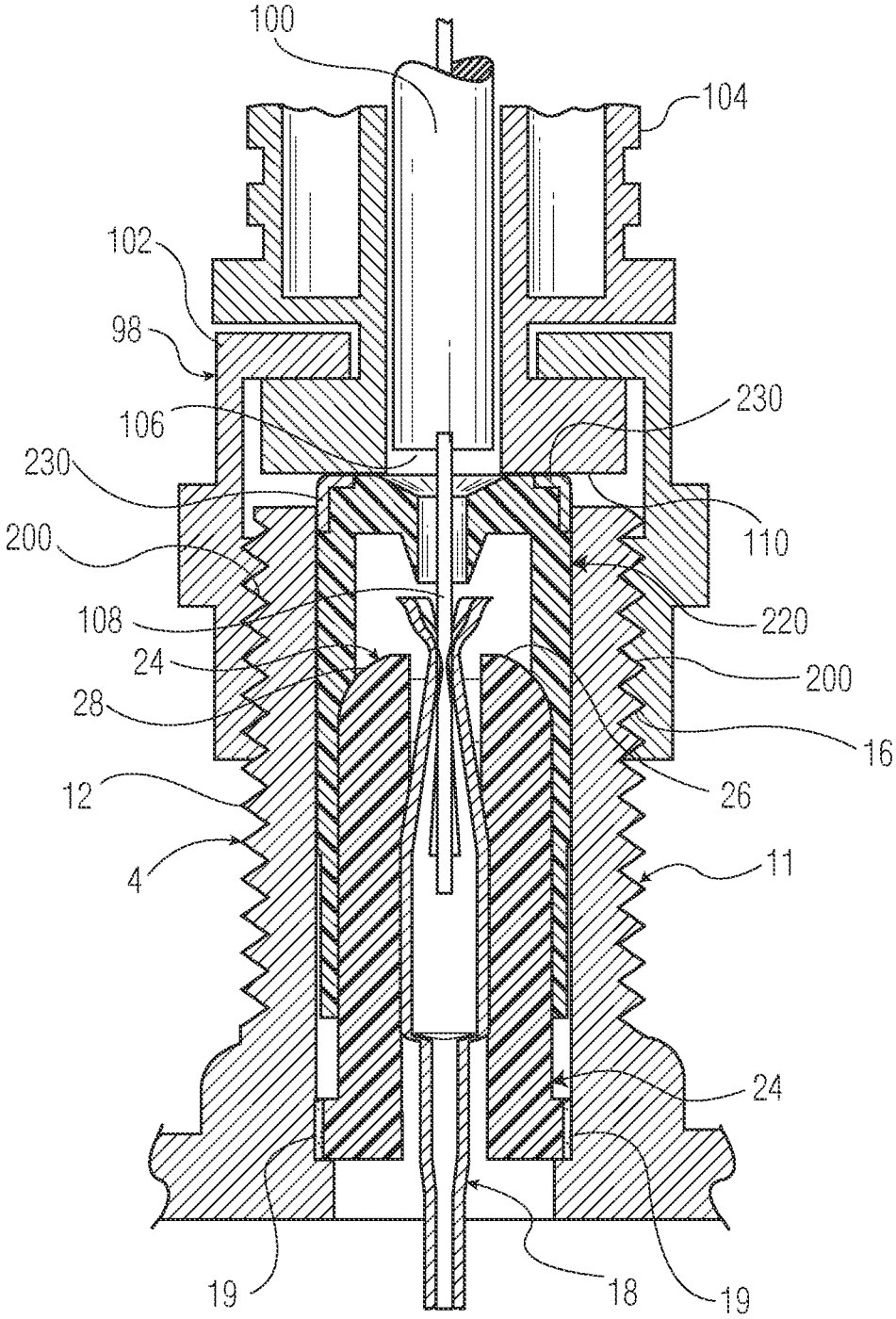
FIG. 24 is a cross-sectional view showing slight loosening of the male coaxial cable connecter from the female coaxial connector while maintaining a ground connection therebetween for an embodiment of the invention.

The operation of various embodiments of the invention will now be described. In this example an F-type male coaxial cable connector 98 has installed therein a coaxial cable 100. As would be known to one of skill in the art, the F-connector 98 includes a nut component 102 for facilitating screwing the male connector 98 onto a female F-type connector 11 (see FIG. 22). The nut component 102 is rotatable with and captively retains a cable retention component 104 that includes a centrally located circular cavity 106 for retaining coaxial cable portion 100, typically by crimping the circular cavity tightly around the coaxial cable. The nut component 102 and cable retention component 104 are made from suitable electrically conductive material. Outer insulation of the coaxial cable 100 is removed at an end portion to expose the center conductor 108 of the coaxial cable. The assembly of the male F-connector 98 includes lower internal threads 200 for installation onto an F-type female connector or port 11, 10 or 4, such as the top threaded portion 16 of connector 10 of FIG. 2B, for example. The initial installation of the male F-connector assembly before tightening onto the threads 16 of barrel 12 is shown in FIG. 22. It is important to note that the center conductor 108 of the coaxial cable 100 is pushed into the female pin 18, forcing apart spring arms 44 and 46 of female pin 18, whereby the coaxial cable conductor 108 is mechanically retained and in electrical contact with the semi-circular portions 53 of the female pin 18, spring arms 44 and 46. This is an important feature of the present invention, in that even if a push-on type male connector assembly (not shown) is installed on connector 10, the center conductor 108 or male pin of such a push-on connector will be both in mechanical retention and electrical contact with the female pin 18, ensuring proper electrical operation and continuity between the coaxial cable and the female pin 18. However, the advantage of using the screw-on male F type coaxial cable connector 98 is that after the nut 102 is completely and tightly screwed onto the threads 16 of threaded barrel 12 as shown in FIG. 23, the cap 220 will be pushed downward via the bottom surface of 110 of cable retention component 104, whereby cap 220 will as a result of its downward movement force resilient arms 26 and 28 of pin carrier 24 to move toward one another, in turn forcing spring arms 44 and 46 of female pin 18 to be pushed more closely together in a forceful manner for firmly retaining the center conductor 108 of coaxial cable 100 therebetween. As shown in FIG. 24, if the male connector 98 loosens due to vibration or temperature changes, for example, the cap 220 moves upward via the action of the resilient arms 26 and 28 spreading apart, whereby within a range of loosening electrically conductive cover 230 maintains mechanical and electrical contact between the male and female connectors 98, 11, respectively, thereby maintaining the ground connection therebetween. The electrically conductor cover 230 helps to maintain the electrical connection between the shells of male connector 98 and female connector 10. Note that although as previously indicated the push-on F-type male connector assemblies are operative with the present invention, a much more positive mechanical and electrical connection will be made between the female pin 18 and center conductor 108 through use of the screw-on F-type male connector, as immediately described above, for example. In this regard, for commercial installations, pin 180 (see FIG. 9E) can be used as described above, whereby the mechanical and electrical securement of pin 180 is obtained upon tightening of male connector 98 onto female connector 10 or 4.

The various components of the present invention in its various embodiments can be fabricated from suitable materials. For example, the electrically conductive covers 23, 25, 38, 72, 76, and 230 can be made from copper, beryllium copper, gold, and other suitable electrically conductive materials. Also, the covers 23, 25, 38, 72, 76, and 230 can be secured to the upper portion of their associated caps 22 or 220 through use of suitable adhesives, or applied in a molding process. The barrel 12 of female connector 10, and the shell of male connector 98 can be made from brass or other suitable material. The barrel 12 can also be provided by cast metal material as zinc alloy, or other suitable material. The cap 22 and pin carrier 24 can be provided by any suitable electrically nonconductive material, for example, plastic material such as Delrin® or polyoxymethylene (POM), or other suitable material. Also, cap 22 or 220 and pin carrier 24 are preferably unitary components of molded or extruded suitable plastic material.

The alternative electrically conductive covers 23, 38, 72, 76, and 230 help to retain a ground connection between a male connector 98 and female connector 10 or 4, for example, even if the male connector 98 has its securement to a female connector 10 or 4 loosen. In this manner spurious radiation from and interference with the RF signal carried via male pin 108 is substantially reduced or avoided even if the mechanical securement between the female and male connectors 10, 98, respectively, loosens. More specifically, in this example, as nut 102 of male connector 98 loosens from threads 16 of a female connector 4 or 10, and cable retention component 104 moves upward from connector 10, cap 22 moves upward as a result of resilient spring arms 26 and 28 of pin carrier 24 moving away from pin 18, whereby at least for the range of movement of about one millimeter the top of cap 22 maintains contact with the bottom of cable retainer 104. In this regard so long as such contact can be maintained, for the embodiment employing conductive cover 23 on cap 22, the electrical ground connection is retained by the top portion of cover 23 maintaining contact with the bottom of component 104, and the bottom circumferential portion 204 maintaining contact with interior side wall portions of barrel 12. Similarly when cover 25 is employed on cap 22, the protruding circular nib 30 maintains mechanical and electrical contact with interior sidewall portions of barrel 12, and the top portion maintains contact with the bottom component 104. With use of cover 38, the top of circular flange 70 contacts the bottom of component 104, and the lower circumferential outer wall 202 maintains frictional and electrical contact with barrel 12. With use of cover 72, relative to use of cover 23, the difference is that the semicircular nibs 74 maintain mechanical and electrical contact with the interior walls of barrel 12. With use of cover 76, relative to use of cover 23, the resilient or flexible spring fingers 80 retain mechanical and electrical contact with interior wall portions of barrel 12.

Figure 25:
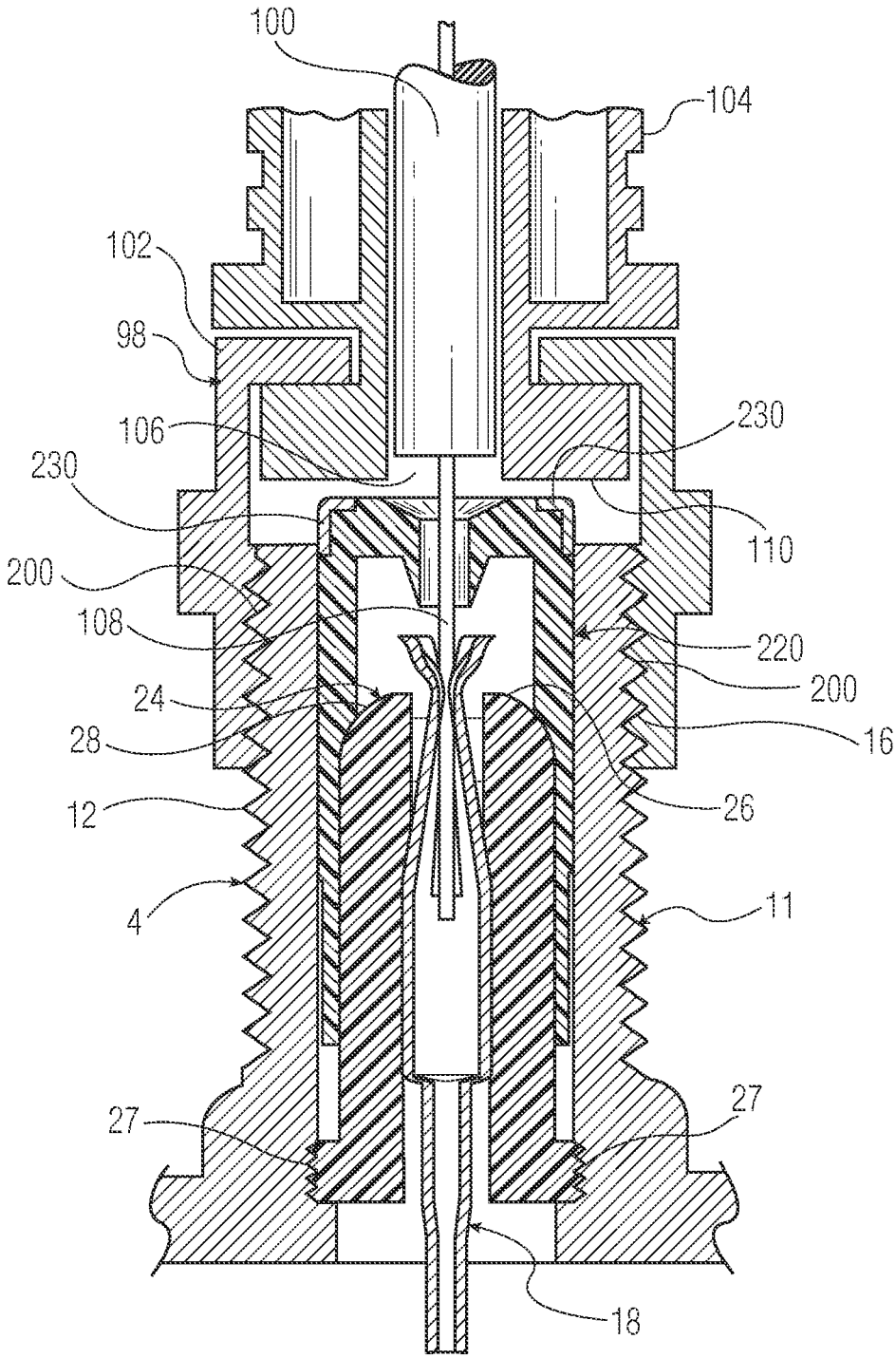
FIG. 25 is a cross-sectional view of a connector mechanism that is installed into the open top opening of an associated connector shell via a threaded securement.

Note that in FIG. 2B, the assembled female connector mechanism including cap 22, pin carrier 24, and electrical pin 18, is inserted into the barrel 12 or shell via the latter's open bottom portion. The flange 78 can be a friction fit within barrel 12, or secured by adhesive. Also, as shown in FIGS. 20 and 21, the sealant 90 installed in the bottom of barrel 12 over the bottom of pin carrier 24 and about the lower portion 20 of pin 18, further serves in this embodiment to secure the female connector mechanism within barrel 12. Contrariwise, in the embodiments of FIGS. 22 and 23, the female connector mechanism is inserted into barrel 12 from an opening in the top of the connector shell or barrel 12, and secured via a layer of adhesive 19 between the circumferential sidewall of locking ring 78 and an opposing inner sidewall portion of barrel 12. Alternatively, rather than use a layer of epoxy 19 to secure the female connector mechanism, as shown in FIG. 25, the circumferential sidewall of locking ring 78 is threaded, as is the opposing inner sidewall portion of barrel 12 to provide a screw in or threaded securement 27 therebetween.

The various embodiments of the present invention, as previously mentioned, are not meant to be limited for use with splitters. These embodiments can be utilized with any cable television or RF type devices including female connector ports as herein described for connection to male-type coaxial cable connectors. Also, although various embodiments of the present invention have been shown and described herein, they're not meant to be limiting. Those of skill in the art may recognize certain modifications to these embodiments, which modifications are meant to be covered by the spirit and scope of the pending claims.

What I claim is:

1. A mechanism for maintaining an electrical ground connection between the electrically conductive shells of mated male and female coaxial cable of connectors in the event the mechanical coupling therebetween loosens, comprising:

said female coaxial cable connector including captively retained with its shell:

a circular cap of electrically non-conductive material having a lowermost portion of maximum diameter with outer wall portions slideable against inside walls of said shell, and an uppermost portion less in diameter than said lowermost portion, said uppermost portion jutting partly out of the top opening of said shell, a top of said cap including a centrally located hole configured for receiving and guiding a male pin of said male connector into a cavity of said shell;

a female pin secured within said cavity for receiving said male pin;

an electrically conductive unitary cover secured to said cap, said cover being configured to form an outer circumferential band on the top of said uppermost portion of said cap spaced away from its centrally located hole, said cover extending around an outer sidewall portion of said uppermost portion, and further extending around at least an upper portion of a sidewall of said lowermost portion of said cap, for maintaining electrical and mechanical contact with said shell; and spring biasing means within said shell configured for pushing said cap upward to extend the uppermost portion of said cap upward to retain electrical contact with an outer face of the shell of said male connector if it mechanically loosens over a range from rigid securement with said female connector, said spring biasing means further permitting said cap to move downward to a maximum extent upon rigid securement of said connector to said female connector.

2. The mechanism of claim 1, wherein said electrically conductive cover and said cap are configured to provide for said outer circumferential band to be flush with the top of said cap, and at least portions of said cover upon sidewall portion of said cap being in slidable contact with opposing inner sidewalls of said shell.

3. The mechanism of claim 2, wherein said cover further includes a semicircular ring or band and protruding outward from a bottommost portion for slideably contacting the opposing associated inner sidewall of said shell.

4. The mechanism of claim 2, wherein said cover further includes a side ring of spaced apart nibs or semicircular protrusions extending outward from a bottommost portion for slidably contacting opposing associated inner sidewalls of said shell.

5. The mechanism of claim 2, wherein said cover further includes a plurality of spaced apart flexible spring fingers around its bottommost side portion for slideably contacting the opposing associated inner sidewall of said shell.

6. The mechanism of claim 1, wherein said electrically conductive cover is configured to provide for its said outer circumferential band to extend above and have a greater diameter than the top of said cap, and at least portions of said cover upon sidewall portions of said cap being in slideable contact with opposing inner sidewalls of said shell.

7. A female coaxial cable connector comprising:

an electrically conductive cylindrical shell including centrally located openings in top and bottom portions, respectively, and a centrally located cavity having inner sidewalls;

a female connector mechanism configured for being securely retained within the cavity of said housing, said mechanism including:

an electrically non-conductive pin carrier including two spaced apart opposing resilient arms in an uppermost portion thereof, said resilient arms each having a free end, and a lowermost portion having a centrally located through hole, said arms extending from said lowermost portion toward the top of said housing, a bottom portion being proximate the bottom portion of said housing;

an electrically conductive female pin including:

two spaced apart opposing spring-like arms in an upper portion configured for receiving therebetween and mechanically engaging an end of a center conductor of a coaxial cable or central pin of a mating male coaxial connector to immediately provide an electrically conductive path therebetween, a circular middle portion from which said spring-like arms extend, a circular lower portion of smaller diameter than and extending from a central portion of said middle portion, a centrally located through hole extending through said middle and lower portions;

said female pin being securely retained within said pin carrier, with the outwardly flared ends of said female pin being positioned above said resilient arms, the lower portion of said pin protruding away from or out of the bottom portion of said pin carrier, and a centrally located hole in the bottom of said housing; and an electrically non-conductive circular cap having a top and bottom, configured for secure installation of its bottom portion over at least top portions of both said resilient arms of said pin carrier, and said female pin, respectively, an upper portion of said cap jutting partly out of the top opening of said housing or shell, a top of said cap including a centrally located hole configured for guiding the center conductor of a coaxial cable or male pin of a mating male connector into the central portion of said female pin, an interior of said cap being hollow with interior walls configured to permit said cap to move downward to exert an inward force on the resilient arms of said pin carrier as a mating male connector is installed onto the housing or shell of said female coaxial connector, for in turn causing said resilient arms to exert an inward force on the spring-like arms of said pin, for obtaining increased mechanical and electrical connection between said male and female pins, whereas as an installed male connector is removed from said shell, said resilient arms move outward forcing said cap to move upward;

a unitary electrically conductive cover secured to top and sidewall portions of said cap, said cover being configured to form an outer circumferential band on the top of said cap spaced away from the cap's centrally located holes, said cover extending around sidewall portions of said cap for maintaining electrical and mechanical contact with said shell.

8. The connector of claim 7, wherein said cover and said cap are configured to provide for said circumferential band to be flush with the top of said cap, and at least sidewall portions of said cover being in slideable contact with opposing inner sidewalls of said shell.

9. The connector of claim 8, wherein said cover further includes a semicircular ring or band protruding outward from a bottommost portion for slideably contacting the opposing associated inner sidewall of said shell.

10. The connector of claim 8, wherein said cover further includes a side ring of spaced apart nibs or semicircular protrusions extending outward from a bottommost portion for slidably contacting opposing associated inner sidewalls of said shell.

11. The connector of claim 8, wherein said cover further includes a plurality of spaced apart flexible spring fingers around its bottommost side portion for slideably contacting the opposing associated inner sidewall of said shell.

12. The connector of claim 7, wherein said electrically conductive cover is configured to provide for its said outer circumferential band to extend above and have a greater diameter than the top of said cap, and at least sidewall portions of said cover being in slideable contact with inner sidewalls of said shell.

13. The connector of claim 7, wherein said female pin further includes a through hole in the lower portion thereof for permitting sealant to be injected into and fill the interior cavities of at least lower portions thereof, for preventing moisture from migrating from the upper portion into the middle portion, and therefrom through the lower portion, into a device associated with said connector.

14. The connector of claim 13, further including the lower portion of said female pin protruding from the bottom of said pin carrier being partially surrounded by a circular cavity formed both by the opening in the bottom portion of said housing, and by the bottom of said pin carrier, the circular cavity serving to receive sealant material for filling the cavity and surrounding an associated portion of said female pin, for preventing moisture from migrating through said housing or shell and said pin carrier into an associated device to which said connector is attached.

15. The connector of claim 7, further including a resilient locking ring about the end of the lowermost portion of said pin carrier, said locking ring being dimensioned to frictionally engage interior wall portions of the cavity of said housing, for securely retaining said pin carrier in said housing.

16. The connector of claim 7, wherein the two opposing spaced apart opposing resilient arms of said pin carrier each have interior semicircular walls for receiving said female pin.

17. The connector of claim 7, further including the lower portion of said female pin protruding from the bottom of said pin carrier being partially surrounded by a circular cavity formed both by the opening in the bottom portion of said housing, and by the bottom of said pin carrier, the circular cavity serving to receive sealant material for filling the cavity and surrounding an associated portion of said female pin, for preventing moisture from migrating through said housing or shell and said pin carrier into an associated device to which said connector is attached.

18. The connector of claim 7, further including an uppermost portion of said cap being of lesser diameter than lowermost portions.

19. The connector of claim 7, further including:

said free ends of said resilient arms of said pin carrier being rounded; and an uppermost portion of the interior walls of said cap being of reduced diameter immediately followed by a diverging interior wall portion of greater diameter configured for exerting a radially directed inward force against associated rounded free end portions of said resilient arms, respectively, as said cap moves downward upon said pin carrier, thereby causing said resilient arms to move toward one another.

20. The connector of claim 1, wherein said pin, said pin carrier, and said cap are each made from a single piece of material.

* * * * *